US006678957B2

(12) United States Patent
Floessholzer

(10) Patent No.: US 6,678,957 B2
(45) Date of Patent: Jan. 20, 2004

(54) PERSONAL CARE APPARATUS WITH FRICTION REDUCING DISCS

(75) Inventor: Hannes Floessholzer, St. Paul (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 43 days.

(21) Appl. No.: 10/105,525

(22) Filed: Mar. 25, 2002

(65) Prior Publication Data

US 2002/0138988 A1 Oct. 3, 2002

(30) Foreign Application Priority Data

Mar. 27, 2001 (EP) ..... 01890095

(51) Int. Cl.[7] ..... B26B 19/42; B26B 21/40
(52) U.S. Cl. ..... 30/34.2; 30/34.1; 30/43.92
(58) Field of Search ..... 30/34.2, 537, 43.92, 30/43.91, 34.05, 43.9; D24/215, 214; 601/84

(56) References Cited

U.S. PATENT DOCUMENTS

| | | | | | |
|---|---|---|---|---|---|
| 2,362,666 | A | * | 11/1944 | Sarver | |
| 2,880,503 | A | | 4/1959 | Carissimi | |
| 2,952,907 | A | * | 9/1960 | Miller | 30/34.2 |
| 3,127,675 | A | * | 4/1964 | Kobler | 30/34.2 |
| 3,166,842 | A | * | 1/1965 | Christensen et al. | 30/34.2 |
| 4,038,747 | A | * | 8/1977 | Upton | 30/34.2 |
| 4,754,547 | A | * | 7/1988 | Butka | |
| 5,933,960 | A | * | 8/1999 | Avidor | |
| 6,070,327 | A | * | 6/2000 | Taso | |

FOREIGN PATENT DOCUMENTS

| | | | |
|---|---|---|---|
| AU | 213581 | | 11/1957 |
| GB | 665042 | * | 1/1952 |
| WO | WO-9604110 | * | 2/1996 |

OTHER PUBLICATIONS

Search Report for PCT/IB02/00687, dated May 28, 2002.*

* cited by examiner

*Primary Examiner*—Hwei-Siu Payer

(57) ABSTRACT

In a personal care apparatus (1) with a housing (2) and with a frame (3) which is connected to the housing (2) and has two longitudinal walls (4, 5) and two transverse walls (6, 7), a disc (12, 13) arranged and rotatably mounted in a cutout (14, 15) in the relevant transverse wall (6, 7) is provided as a friction reducing part in the region of each transverse wall (6, 7), which two discs (12, 13) can roll on the skin of a body part of a person during the cosmetic operation.

4 Claims, 1 Drawing Sheet

PERSONAL CARE APPARATUS WITH FRICTION REDUCING DISCS

Figure 1:
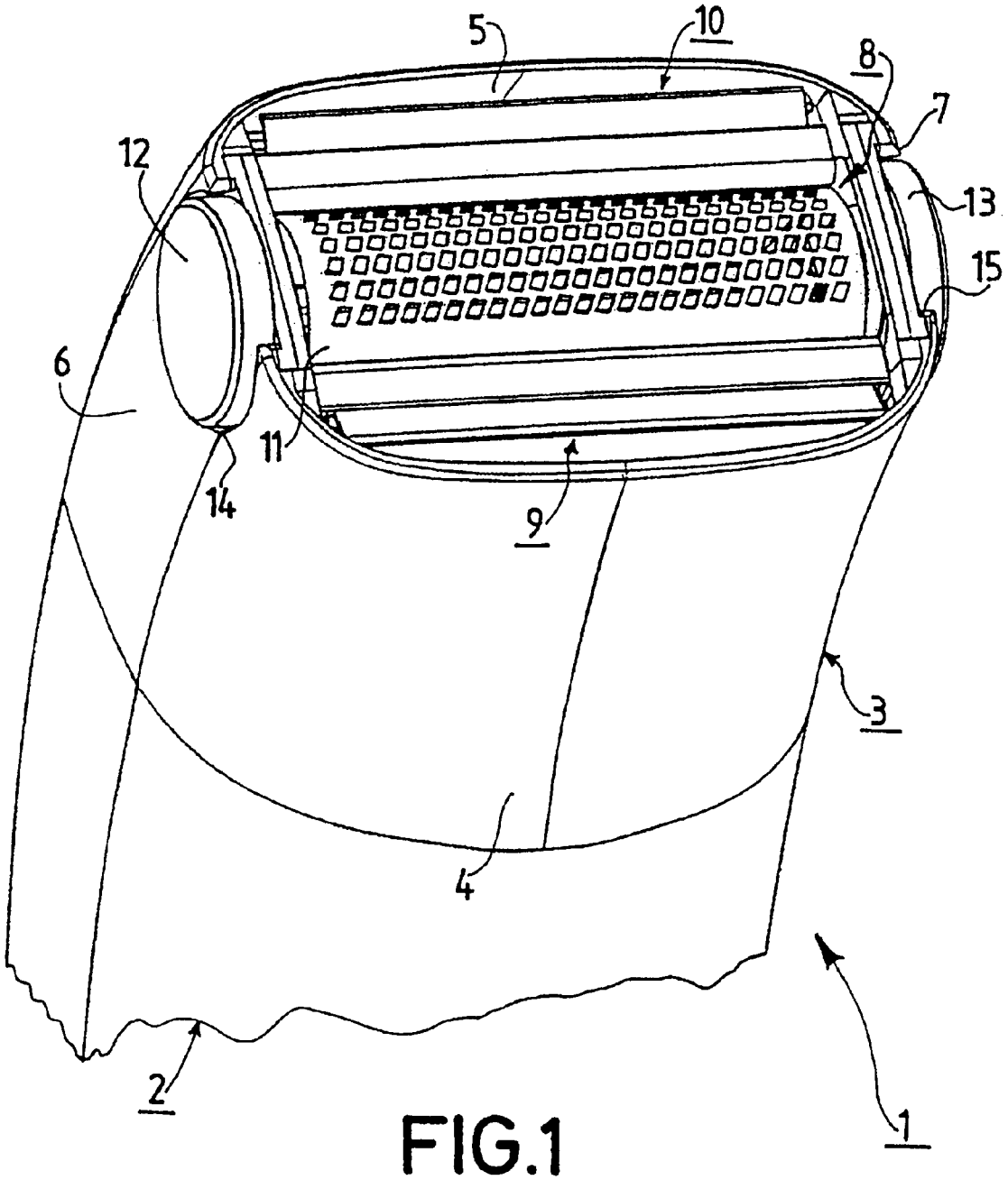

The invention relates to a personal care apparatus with a housing and with a frame which is connected to the housing and has two longitudinal walls and two transverse walls, at least one apparatus part being provided for personal care in the region of the frame, and at least one friction reducing part being provided which is designed for rolling on a body part of a person and mounted rotatably for this purpose.

A personal care apparatus as described above in the first paragraph is disclosed in patent document U.S. Pat. No. 2,880,503 A and in the patent document AU 213 581 corresponding thereto. This personal care apparatus is a shaver. In the known shaver, two friction reducing parts are provided which are formed by two rotatably mounted cylindrically designed bodies of revolution which are arranged in the region of the free ends of the longitudinal walls of the frame and are rotatably mounted in the transverse walls of the frame there, which transverse walls are designed such that they are longer than the longitudinal walls. In this case, the bodies of revolution run substantially parallel to the longitudinal direction of cutting blades provided inside the frame of the shaver. When this shaver is used, the shaver is usually moved transverse to the longitudinal direction of the cutting blades over a body part or over the skin of a person in order to cut off hairs. A problem in the known shaver is that the bodies of revolution provided as the friction reducing means are situated in the usual direction of operational movement of the shaver ahead of the cutting blades and during operation press down the hairs to be cut against the skin, which in the case of longer hairs may have the result that these longer hairs pressed down by the bodies of revolution cannot be raised quickly enough and therefore cannot be cut off by the cutting blades that subsequently come into action, the result of this being shaving of unsatisfactory quality. Furthermore, the bodies of revolution have an unfavorable influence on the ability of the shaver to be maneuvered easily over sections of skin of a person because of their length. A further unfavorable state of affairs arises in the known shaver because the provision of the bodies of revolution requires the frame of the shaver to be designed such that it is relatively large as far as its width is concerned, i.e. the shaver has a large width in its frame region, something which is disadvantageous particularly when the aim is to carry out shaving in the region of body zones that are difficult to reach, for example, in the armpit region or in the bikini region.

The invention has for its object to eliminate the state of affairs described above, which is unfavorable for a personal care apparatus, and to create an improved personal care apparatus.

In order to achieve the above object, inventive features are provided in a personal care apparatus in accordance with the invention such that a personal care apparatus in accordance with the invention can be defined as follows:

A personal care apparatus with a housing and with a frame which is connected to the housing and has two longitudinal walls and two transverse walls, and with at least one apparatus part for personal care provided in the region of the frame, and with at least one friction reducing part provided for rolling on a body part of a person and rotatably mounted for this purpose, the friction reducing part being formed by a disc which is provided in the region of a transverse wall and is arranged so as to extend at least substantially parallel to the transverse wall.

The features in accordance with the invention, render it possible to implement a personal care apparatus with friction reducing parts in which the provision of the friction reducing parts leads virtually to no enlargement of the personal care apparatus in the region of its frame by few and simple means and, in addition, also in a structurally simple way. Furthermore, the measures in accordance with the invention ensure that the personal care apparatus can be maneuvered easily relative to the skin of a person, because owing to its disc-shaped design, a disc provided as friction reducing part can easily follow changes in direction as the personal care apparatus is moved over the skin of a person. Furthermore, the advantage is obtained in a personal care apparatus in accordance with the invention that, no negative influence is exerted on the personal care process that can be carried out with the aid of the personal care apparatus thanks to the fact that a disc is provided as the friction reducing part.

In a personal care apparatus in accordance with the invention, it has proved to be particularly advantageous when one cutout each is provided in at least one transverse wall, but preferably in both transverse walls, and a disc acting as a friction reducing part is arranged in each cutout. Particularly advantageous conditions are ensured with such a design.

A personal care apparatus in accordance with the invention is designed in a particularly advantageous way as a foil shaver. However, it may be pointed out explicitly that a personal care apparatus in accordance with the invention may also be formed by a shaver with rotatably driven blades, or by what is termed a depilation apparatus with depilation discs that can be driven into rotation, or with depilation cylinders that can be driven into rotation. A personal care apparatus in accordance with the invention may also be designed as a massage device or as a skin treatment apparatus with a vacuum nozzle. Such personal care apparatuses, which may also be denoted body treatment apparatuses, may be provided not only for private home use, but also as professional, preferably medical apparatuses for use in hospitals or physicians' consulting rooms or massage institutes, for example as massaging devices or as laser treatment devices and the like.

The above and further aspects of the invention will become apparent from the embodiment described below and will be explained with reference to this embodiment.

The invention will be described in more detail below with reference to an embodiment shown in the drawing, to which, however, the invention is not limited.

FIG. 1 is an oblique view of part of a personal care apparatus in accordance with the invention, in this case a foil shaver.

FIG. 1 shows a personal care apparatus 1, a so-termed foil shaver denoted apparatus 1 below for short. The apparatus 1 has a housing 2 to which a frame 3 can be detachably connected. The frame 3 has two longitudinal walls 4 and 5 and two transverse walls 6 and 7, of which FIG. 1 shows clearly only the transverse wall 6.

The apparatus 1 is fitted with a short-hair cutting system 8 and with two longhair cutting systems 9 and 10. The two long-hair cutting systems 9 and 10 are shown diagrammatically only in FIG. 1. The two long-hair cutting systems 9 and 10 are so-termed toothed cutting devices which each have a stationary toothed blade and a driveable toothed blade that is guided to and fro along the stationary toothed blade. Like the short-hair cutting system 8, the two long-hair cutting systems 9 and 10 are provided inside the frame 3. In this arrangement, the two long-hair cutting systems 9 and 10 can be displaced from the rest position shown in FIG. 1 into an extended position (not shown in FIG. 1) by displacing means (not shown). The short-hair cutting system 8 has a sieve-type shaving foil 11 (visible in FIG. 1) as its upper blade. Cooperating with the sieve-type shaving foil 11 is a lower blade (not visible in FIG. 1), which has blade lamellae that are juxtaposed and have cutting edges running arcuately, and which can be driven to and fro by a drive motor.

The device 1 advantageously has two friction reducing parts 12 and 13 that are provided for rolling on a body part of a person and are rotatably mounted for this purpose in a way not shown in more detail. As is clearly to be seen from FIG. 1, each friction reducing part 12 or 13 is formed by a disc 12 or 13 here. Each of the two discs 12 and 13 is provided in the region of a transverse wail 6 and 7 and arranged so as to be centrally positioned with respect to the relevant transverse wall 6 or 7 and extends at least substantially parallel to the relevant transverse wall 6 or 7. Here, a cutout 14 or 15 is provided in an upper end of each transverse wall 6 or 7, and the relevant disc 12 or 13 is arranged in the cutout 14 or 15 provided for it. The advantage of accommodating the two discs 12 or 13 in the cutouts 14 or 15 of the transverse walls 6 and 7 is that the discs 12 and 13 are provided virtually without any additional space requirement in the apparatus 1, such that the provision of the two discs 12 and 3 as the friction reducing parts causes no undue enlargement of the apparatus 1 in the region of its frame 3.

Advantageously, the sliding properties of the apparatus 1 during a shaving operation are good thanks to the provision of the two discs 12 and 13, which has a particularly favorable effect during a shaving operation in the region of softer parts of the body and offers a particular advantage when perspiration also occurs at these softer parts of the body, because there is then no uneven, and thereby jerky onward movement of the apparatus 1 during a shaving operation, as is the case with known shavers. Such a jerky onward movement, frequently referred to as the slip-stick effect, results in hairs cropped to uneven lengths, something which is, however, prevented with the apparatus 1 of FIG. 1 as a consequence of the provision of the discs 12 and 13. Owing to the provision of the discs 12 and 13, the shaver 1 can be guided more easily and accurately over the skin of a person, and the shaver 1 can be moved over the skin of a person with particularly little effort owing to the rolling of the discs 12 and 13 on the skin of a person, which is perceived as pleasant and user-friendly by a person manipulating the apparatus 1.

What is claimed is:

1. A personal care apparatus (1)

with a housing (2) and with a frame (3) which is connected to the housing (2) and two longitudinal walls (4, 5) and two transverse walk (6,7), and with at least one apparatus part (8, 9, 10, 11) for personal care provided in the region of the frame (3);

and with at least one friction reducing part (12, 13) provided for rolling on a body part of a person and rotatably mounted for this purpose, the friction reducing purl (12, 13) being formed by a disc (12, 13) which disc (12, 13) is provided in a cutout (14, 15) in at least one of the transverse walls (6, 7) and is arranged so as to be centrally positioned with respect to the at least one of the transverse walls (6, 7) and at an upper end of the at least one or the transverse walls (6, 7) adjacent to the at least one apparatus cart (5, 9, 10, 11) and extends at least substantially parallel to the at least one of the tranverse walls (6, 7).

2. A personal care apparatus (1) as claimed in claim 1, wherein two discs (12, 13) are provided as the friction reducing parts (12, 13), each of which is centrally positioned with respect to a respective one of the transverse walls (6, 7) and at an upper end of its respective one of the transverse walls transverse (6, 7) adjacent to the at least one apparatus part (8, 9, 10, 11).

3. A personal care apparatus (1) as claimed in claim 1, wherein said cutout (14, 15) is provided in each of the two transverse walls (6, 7), and wherein a disc (12, 13) is arranged in each cutout (14, 15).

4. A personal care apparatus (1) as claimed in claim 1, which personal care apparatus (1) is constructed as a foil shaver (1).

* * * * *